US005672030A

United States Patent [19]

Dean

[11] Patent Number: 5,672,030

[45] Date of Patent: Sep. 30, 1997

[54] METHOD OF MAKING BOOKS

[75] Inventor: Robert Wayne Dean, Winchester, Va.

[73] Assignee: Berryville Graphics, Berryville, Va.

[21] Appl. No.: 581,938

[22] Filed: Jan. 2, 1996

[51] Int. Cl.[6] ..... B42B 5/00

[52] U.S. Cl. ..... 412/7; 412/1; 412/6; 412/8; 281/21.1

[58] Field of Search ..... 412/1, 6, 8, 33, 412/34, 37, 900, 901, 902; 281/21.1; 156/314, 908, 322

[56] References Cited

U.S. PATENT DOCUMENTS

| | | | |
|---|---|---|---|
| 2,523,860 | 9/1950 | Budden | 412/37 |
| 3,214,193 | 10/1965 | Monroe | 156/908 |
| 3,244,436 | 4/1966 | McKowen | 156/908 |
| 3,717,366 | 2/1973 | Decker | 412/900 |
| 4,296,294 | 10/1981 | Beckert et al. | 156/908 |
| 4,536,012 | 8/1985 | Hume, III | 412/8 |
| 4,907,822 | 3/1990 | Carter et al. | 156/908 |

FOREIGN PATENT DOCUMENTS

| | | | |
|---|---|---|---|
| 2716575 | 10/1978 | Germany | 412/37 |
| 788459 | 1/1958 | United Kingdom | 412/37 |

*Primary Examiner*—Maurina Rachuba
*Assistant Examiner*—Gregory Andoll
*Attorney, Agent, or Firm*—Reid & Priest LLP

[57] ABSTRACT

A stack of unbonded perforated book signatures receives cold pva adhesive applied to the spine and hot eva adhesive is promptly applied in not more than approximately ten minutes prior to setting of the cold adhesive to permit the fabrication of a book of greatly enhanced durability.

13 Claims, 2 Drawing Sheets

METHOD OF MAKING BOOKS

BACKGROUND OF THE INVENTION

1. Field of the Invention

The present invention is in the field of bound books and methods of making bound books. More specifically, the present invention is directed to a new and improved method of expeditiously making a bound book having improved toughness and durability.

Bound books have been in existence for hundreds of years and bookbinders have employed a variety of procedures in an effort to provide a finished book which has a good feel and appearance and which will be long lasting. Unfortunately, the need for providing reliability and durability in a book is in direct conflict with the need for a sufficiently low price to make it commercially attractive.

Books that are frequently used such as hymnals, dictionaries, textbooks and the like must be of much sturdier and reliable construction than would be necessary for a novel or other type book which may only be used a few times.

Prior known book binding procedures for securing the signatures of books in the binding have employed the initial application of a cold adhesive subsequently followed by the application of hot adhesive at a substantial time after the setting of the cold adhesive in the spine portion of the book. The book is then rounded on a round and back apparatus with the resulting book having insufficient durability and an inability to retain its shape due to the absence of position maintaining memory in the adhesives. The Smyth Sewn procedure of the prior art is possibly the best known prior art procedure for forming a durable book; unfortunately, this procedure requires a time consuming and expensive sewing of the individual signatures into the book.

SUMMARY OF THE INVENTION

The present invention in its preferred mode comprises the initial provision of a conventional collated stack of perforated signatures formed by a gathering machine in a well known manner. The stack of signatures is then moved by a conventional conveyor through a conventional tipping unit in which the end sheets are applied and glued to the first and last signature of the stack in a well known manner. The stack of signatures are then fed into a conventional binder and cold polyvinyl acetate ("pva") adhesive is applied by conventional means to the exterior of the spine section of the stack so as to pass inwardly through the perforations in the sheets of each signature. The stack of signatures is then moved past a series of heaters in which the cold adhesive is partially dried but not completely set to form a book block (a "book block" being here defined as a stack of signatures which has been bound).

After partial drying, the book block exits the binder and is conveyed to a conventional book splitter for trimming to proper size if the book block is in a 2 UP format; or if the book block is in single form, the book block is conveyed to a conventional three knife trimmer and in either case the book block is trimmed to proper dimensions. The trimmed book block is then expeditiously conveyed to a conventional round and backer. The book block at the time it is moved into the round and backer is very soft and the cold adhesive has no memory so that the round and backer can easily install as much round as the customer requires. The operation of the round and backer on the book block results in an inwardly concave configuration of the outer pages with a similar outward bulging on the spine side of the book block to provide a curved outer surface having a diameter or thickness greater than the thickness of the book block in areas other than the spine area.

After exiting the round and backer, the total surface area of the spine of the book block has been increased and a first thin layer of hot ethyl vinyl acetate ("eva") adhesive is applied to the book block by conventional means. The hot adhesive covers the spine and flows inwardly into the perforations provided in the spine area so that it merges into and bonds with the pages of the book block in the spine area as well as with the cold adhesive previously applied to the spine area. The hot eva adhesive has shape retaining memory so the book block is maintained in its rounded condition.

A critical aspect of the method is that the hot adhesive must be applied to the book block prior to the setting of the cold pva adhesive and must consequently be effected within a time period of no more than approximately 10 minutes following the application of the cold pva adhesive and the drying of same in the binder apparatus. Failure to quickly effect the application of the hot eva adhesive will result in the breakage of the cold adhesive following use of the finished book so that the durability of the book will be markedly decreased.

After the first hot eva adhesive is applied, a ribbed crash or super fabric reinforcement material is applied to the hot adhesive on the spine of the book block. The book block is then conveyed to a subsequent conventional workstation where a second layer of hot eva adhesive is applied on the spine of the book block over the reinforcement material and head and foot bands are added at a conventional head and foot station, if desired. From the head and foot station, the book block goes through the normal process of having a case applied to form a book ("book" being here defined as a book block with the case applied) and then through a conventional building in machine and on through a conventional jacketing machine, if required, to form a finished book.

It has been found that a book of greatly enhanced durability can be formed by the inventive process in as little as 6½ minutes from the time the signatures are passed from the gathering machine to the final provision of a jacketed book ready for shipment.

BRIEF DESCRIPTION OF THE DRAWINGS

The invention is better understood by reading the following Detailed Description of the Preferred Embodiment with reference to the accompanying drawing figures, in which like reference numerals refer to like elements throughout, and in which.

DETAILED DESCRIPTION OF THE PREFERRED EMBODIMENT

Figures 1, 2, 3, 4, 5, 6:
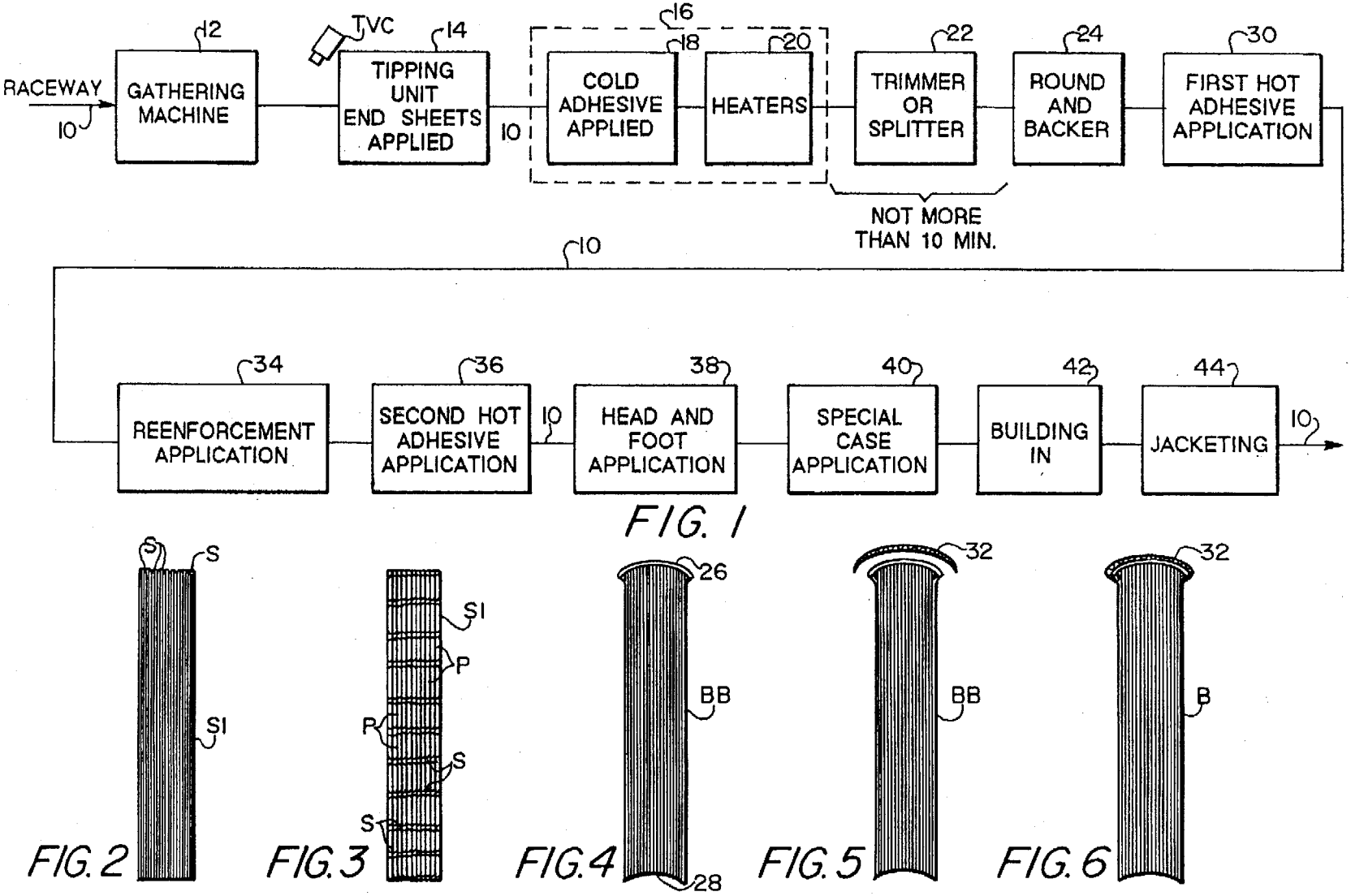
FIG. 1 is a flow diagram illustrating an in-line system for practicing the inventive method.
FIG. 2 is a top view of a collated stack of signatures formed by a conventional gathering machine in known manner.
FIG. 3 is a facing view of the spine side of the collated stack of signatures of FIG. 2.
FIG. 4 is a top view of a book resultant from passage of the stack of signatures of FIGS. 2 and 3 through a binder in which cold adhesive is applied and then dried by heating means, and after passage through a trimmer or splitter and a round and backer in which a hot adhesive is applied to the spine of the book block.
FIG. 5 is a top view of the book block illustrating the application of a reinforcement layer to the hot adhesive on the book spine.
FIG. 6 is a top view of the book block following the application of a second hot liquid adhesive preparatory to the application of head and foot bands and a protective paper layer.
Figure 7:
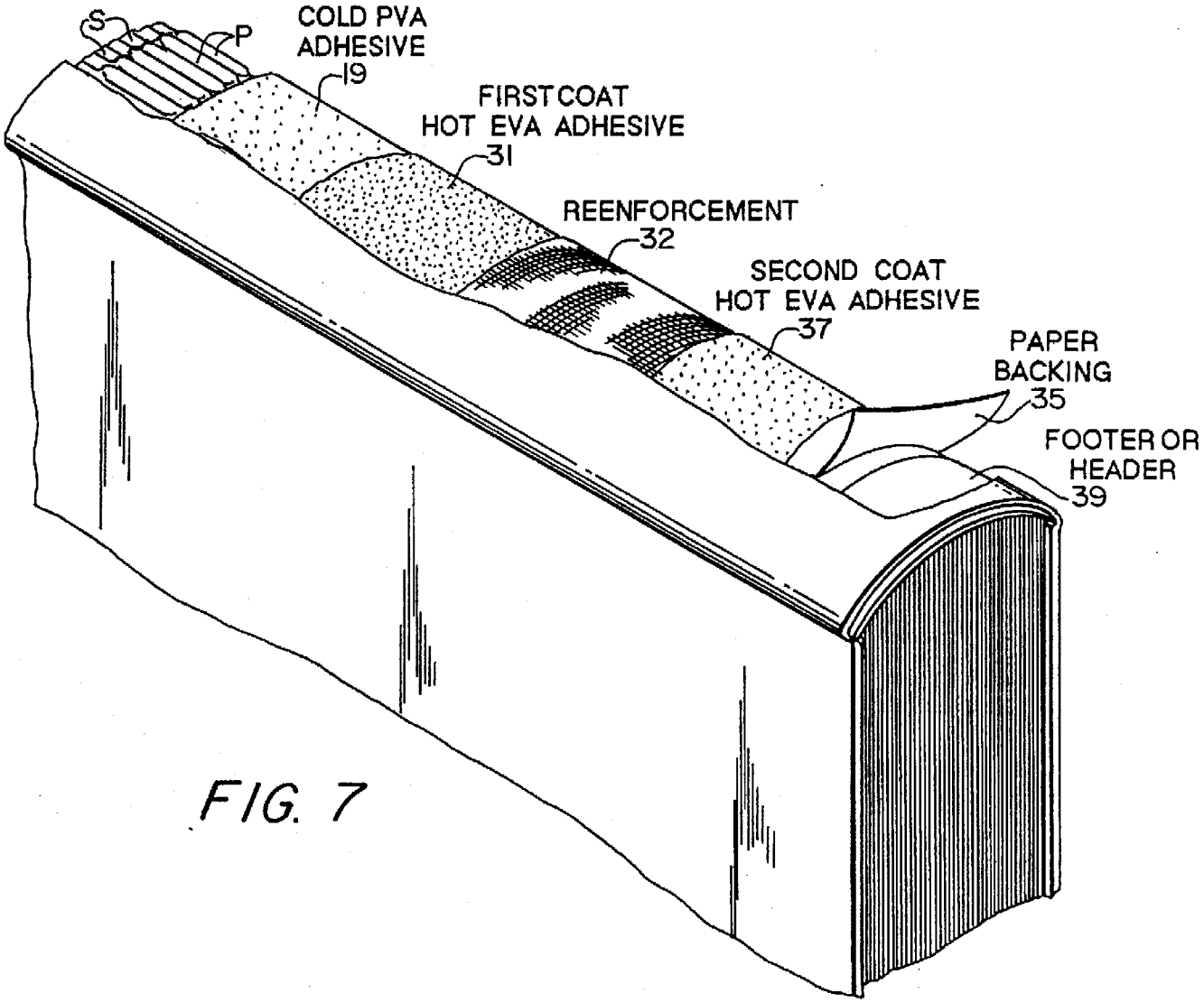
FIG. 7 is a perspective view of the spine of a book formed by the inventive process with portions broken away to illustrate the various components.

Attention is initially invited to FIG. 1 of the drawings, which illustrates an in-line system for practicing the inventive method. A raceway type conveyor 10 of conventional construction conveys the book components through a plurality of work stations, the first of which is a gathering machine 12 in which the individual signatures S are collated into unbundled stacks of signatures S1 as shown in FIGS. 2 and 3. The stacks S1 discharged from the gathering machine 12 are moved by conveyor 10, which passes the books adjacent a television camera TVC that inspects for missing signatures, double signatures or signatures which are not in proper sequence; and any defective books are discarded. The stacks S1 are then conveyed into a conventional tipping unit 14 in which end sheets (not shown) are glued to the first and last signatures in a well known manner. All of the aforementioned structures and operations are conventional.

The stack S1 of unbound signatures discharged from the tipping unit 14 is best illustrated in FIGS. 2 and 3, which respectively comprise a top plan view and a facing view facing the spines of the stack formed of the unbound signatures. It should be noted that each signature includes a plurality of perforations P in vertical alignment as shown in FIG. 3, which are provided for permitting the entry of cold pva adhesive into the interior of the spine portion of the unbonded signatures for effecting the bonding of the individual signatures S together in a manner to be described.

Each stack S1 of unbonded signatures is fed by conveyor 10 from tipping unit 14 into binder unit 16 which includes a conventional cold pva adhesive application workstation 18 and one or more conventional heaters 20. The cold adhesive workstation 18 is of standard construction and includes roller means (not shown) for applying a layer 19 of cold pva adhesive to the spine area of Stack 1 so that the cold adhesive flows into and through the perforations P following which excess cold adhesive is removed from the outer surface of the spine area by conventional means. The stack S1 is then fed by conveyor 10 into the heater unit 20 for partially drying, but not setting, the cold pva adhesive to bind the individual signatures S together to form a book block, as previously defined. By "partially drying" is meant that the cold adhesive is dry on the surface of the book block, but still moist inside the book block. If the cold adhesive is not partially dry (i.e., dry on the surface), then when a hot adhesive is applied, moisture on the surface of the book block will be trapped, creating steam and miniature explosions resulting in an undesirable honeycomb effect on the surface.

Upon completion of the partial drying function, the book block exits the binder unit and is conveyed to a book trimmer or splitter unit 22 which is in the form of a book splitter if the book block is in a 2 UP format; and which is in the form of a three knife trimmer if the book block is in single form, in well known conventional manner. After the book block is trimmed to proper dimensions, the trimmed book block is then conveyed from the trimmer or splitter 22 by conveyor 10 into a round and backer unit 24 of conventional construction.

The round and backer unit 24 applies compressive force on the book block to effect the provision of an outwardly bulging curved spine surface 26 and an inwardly concave page edge surface 28 as best shown in FIG. 4. The resultant book block BB illustrated in FIGS. 4 and 5 is easily achieved since the cold adhesive has not set and has no memory; consequently, the round and backer can provide as much rounding to the book block as the customer desires. It is essential that the elapsed time between discharge of the book block from heaters 20 until feeding of the book block into the round and backer 24 be less than the time required for the cold adhesive to set. Consequently, no more than approximately 10 minutes should pass between the time the book block leaves the heaters of the binder until the book block is acted upon by the round and backer unit 24. Any meaningful delay beyond ten minutes will eventually result in decreased longevity for the finished book.

The book block BB which is discharged from the round and backer is conveyed by conveyor 10 to a conventional first hot adhesive application unit 30 which applies a first layer 31 of hot eva adhesive to the outer curved surface 26 by means of a roller with sufficient pressure to force the hot adhesive inwardly through the perforations P into contact with the previously applied cold pva adhesive. The memory of the hot eva adhesive serves to retain the book spine in the rounded shape of surface 26 shown in FIGS. 4 and 5. The combination of the cold pva adhesive layer applied in the binder 16 and the prompt follow-up application of hot eva adhesive gives the finished book excellent strength and lay-flat ability.

Following application of the first hot eva adhesive layer 31 to the outer surface 26, a conventional reinforcement layer or super 32 made of fabric or the like is applied to the adhesive surface in reinforcement application unit 34 of conventional construction.

A second hot adhesive application unit 36 then receives the book block BB and applies a second thin layer 37 of hot eva adhesive over the reinforcement layer 32. A paper liner or backing 35 is applied over layer 37 and the book block BB is then conveyed to a conventional head and foot applying unit or station 38 where head and foot members 39, only one of which is shown, are optionally applied. The book block BB then goes through the normal conventional procedures of having a special case applied to by means 40 to form a book B, as previously defined. By a "special" case is meant a case having a latex, rather than a conventional paper, liner put inside during manufacture of the case; the latex being more durable than paper. The book B then passes through a conventional building in machine 42 and through a conventional jacketing machine 44 if a jacket is required. The complete fabrication of the book is then effected with the normal procedure taking 6.5 minutes from the press signatures to a complete hardcover jacketed book which is ready for shipment.

A variety of tests performed on books constructed in the aforementioned manner reveals them to be superior to books constructed by prior known procedures such as the Smyth Sewn procedure in terms of durability, lay-flat capability, resistance to case warpage, and ability to maintain physical appearance after repeated usages, as well as other desirable characteristics. Moreover, the costs involved in forming the book are markedly less than with the prior Smyth Sewn procedure.

While modifications of the disclosed inventive method will undoubtedly occur to those of skill in the art, it should be understood that the spirit and scope of the invention is to be limited solely by the following claims.

What is claimed is:

1. A method of making a durable and long lasting book comprising the steps of:

(a) providing a stack formed of a plurality of unbonded perforated collated signatures;

(b) applying cold pva adhesive to the perforations of the stack so that the cold pva adhesive moves inwardly of the perforations;

(c) passing the stack through heating means to partially dry the cold pva adhesive and form a book block;

(d) within approximately ten minutes or less following step (c), passing the book block through a round and backer to provide a curved configuration and increase the surface area of the spine of the book block;

(e) applying a layer of hot eva adhesive to the surface area of the spine of the book block immediately after it leaves the round and backer so that the hot eva adhesive mingles with and bonds to the previously applied cold pva adhesive;

(f) applying a layer of reinforcement material over the layer of hot eva adhesive;

(g) applying a second layer of hot eva adhesive over the layer of reinforcement material; and (h) applying a case to the book block to form a book.

2. The method of claim 1 wherein steps (a) through (h) are completed in approximately 6.5 minutes.

3. The method of claim 1 wherein steps (a) through (h) are performed on an inline system in which the stack and book block are conveyed from step to the next step.

4. The method of claim 3 wherein steps (a) through (h) are completed in approximately 6.5 minutes.

5. The method of claim 4 wherein movement of the book components is effected by an inline conveyor to a series of work stations at which fabrication steps are performed.

6. A method of making a durable and long lasting book comprising the steps of:

(a) providing a stack formed of a plurality of unbonded perforated collated signatures;

(b) applying cold pva adhesive to the perforations of the stack so that the cold pva adhesive moves inwardly of the perforations;

(c) passing the stack through heating means to partially dry the cold pva adhesive, to form a book block;

(d) prior to the setting of the cold pva adhesive, passing the book block through a round and backer to provide a curved configuration and increase the surface area of the spine of the book block;

(e) applying a layer of hot eva adhesive to the surface area of the spine of the book block immediately after it leaves the round and backer so that the hot eva adhesive mingles with and bonds to the previously applied cold pva adhesive;

(f) applying a layer of reinforcement material over the layer of hot eva adhesive;

(g) applying a second layer of hot eva adhesive over the layer of reinforcement material; and (h) applying a case to the book block to form a book.

7. The method of claim 6, wherein steps (a) through (h) are completed in approximately 6.5 minutes.

8. The method of claim 6 wherein steps (a) through (h) are performed on an inline system in which the stack and the book are mechanically conveyed from one step to the next step.

9. The method of claim 8 wherein steps (a) through (h) are completed in approximately 6.5 minutes.

10. The method of claim 6 wherein the book block is passed through the round and backer within less than ten minutes after the completion of step (c).

11. The method of claim 10 wherein steps (a) through (h) are completed in approximately 6.5 minutes.

12. The method of claim 10 wherein steps (a) through (h) are performed on an inline system in which the stack and the book are conveyed from one step to the next step.

13. The method of claim 12 wherein steps (a) through (h) are completed in approximately 6.5 minutes.

* * * * *